United States Patent [19]

Buchwald et al.

[11] Patent Number: 4,906,304

[45] Date of Patent: Mar. 6, 1990

[54] DIFLUOROTETRACHLOROETHANE MIXTURES AND THEIR USE IN REMOVING WAXES

[75] Inventors: Hans Buchwald, Ronnenberg; Boleslaus Raschkowski, Wiedensahl; Dieter Singer, Laatzen, all of Fed. Rep. of Germany

[73] Assignee: Kali-Chemie Aktiengesellschaft, Hanover, Fed. Rep. of Germany

[21] Appl. No.: 148,953

[22] Filed: Jan. 27, 1988

[30] Foreign Application Priority Data

Jan. 28, 1987 [DE] Fed. Rep. of Germany ..... 3702399

[51] Int. Cl.[4] ..... B08B 3/08

[52] U.S. Cl. ..... 134/40; 252/162; 252/170; 252/171; 252/364

[58] Field of Search ..... 134/40; 252/162, 170, 252/171, 364

[56] References Cited

U.S. PATENT DOCUMENTS

| | | | |
|---|---|---|---|
| 3,356,498 | 12/1967 | Moe | 134/40 |
| 3,481,803 | 12/1969 | Soka-shi | 134/40 |
| 3,509,061 | 4/1970 | Zisman | 134/40 |
| 3,737,388 | 6/1973 | Clark et al. | 252/171 |
| 3,833,507 | 9/1974 | Schofield | 134/40 |
| 3,956,162 | 5/1976 | Lautenberger | 252/162 |
| 4,024,086 | 5/1977 | Hutchinson | 134/40 |
| 4,517,108 | 5/1985 | Hisamoto et al. | 252/162 |
| 4,530,776 | 7/1985 | Hisamoto et al. | 252/153 |

FOREIGN PATENT DOCUMENTS

| | | | |
|---|---|---|---|
| 0105427 | 4/1984 | European Pat. Off. . | |
| 0120319 | 10/1984 | European Pat. Off. . | |
| 2149694 | 2/1972 | Fed. Rep. of Germany | 134/40 |
| 50-69389 | 6/1975 | Japan . | |
| 7115444 | 5/1972 | Netherlands | 134/40 |
| 1204634 | 1/1986 | U.S.S.R. . | |
| 1459342 | 12/1976 | United Kingdom . | |

OTHER PUBLICATIONS

Howley, "The Condensed Chemical Dictionary", 9th Ed. (1977), p. 665.

*Primary Examiner*—Asok Pal

*Attorney, Agent, or Firm*—Foley & Lardner, Schwartz, Jeffery, Schwaab, Mack, Blumenthal & Evans

[57] ABSTRACT

New mixtures comprising difluorotetrachloroethane and petroleum ethers are described for use, inter alia, as solvents, particularly for waxes.

2 Claims, No Drawings

DIFLUOROTETRACHLOROETHANE MIXTURES AND THEIR USE IN REMOVING WAXES

BACKGROUND OF THE INVENTION

This invention relates to new mixtures comprising difluorotetrachloroethane and their use.

Mixtures of difluorotetrachloroethane (hereinafter referred to as R112 for convenience) and other constituents which can be used as solvents are already known. For example, it is known from U.S. Pat. No. 3,737,388 that mixtures of R112 with lower aliphatic alcohols or ketones are very effective solvents for fats, oils and waxes. An azeotrope of 93 to 97 wt. % R112 with 7 to 3 wt. % n-heptane has also already been suggested as a solvent for cleaning electronic components. However, for some materials, especially waxes, the dissolving power both of these mixtures and of R112 on its own is not sufficient for particularly demanding applications.

In a further development, therefore, in published European Patent Application EP-A-O No. 120 319 complex mixtures have been suggested as wax solvents which consist of (a) a halogenated hydrocarbon and/or a hydrocarbon and (b) a lower fluorinated alcohol and, optionally, (c) a further polar component.

R112 is also named among other materials as a possible halogenated hydrocarbon constituent of these mixtures. These mixtures are very complex since they are mainly at least ternary mixtures, and their dissolving power is also in need of improvement.

SUMMARY OF THE INVENTION

It is therefore an object of the invention to overcome the disadvantages of the state of the art.

A particular object is to provide simple mixtures based on R112 with improved dissolving power, especially for waxes.

These and other objects are achieved according to the present invention by providing a mixture comprising from 90 to 5 wt. % of difluorotetrachloroethane and from 10 to 95 wt. % of a petroleum ether.

DETAILED DESCRIPTION OF PREFERRED EMBODIMENTS

In this specification, the term difluorotetrachloroethane (also designated R112) is understood to include both 1,1,2,2-tetrachlorodifluoroethane (R112) and the isomeric 1,2,2,2-tetrachloro-difluoroethane (R112a) or mixtures of the two. The preferred R112 referred to hereinafter and used in the Examples is a commercially available mixture of R112 and R112a which may, for example, contain approximately 10% R112a.

Furthermore, in this application, the term petroleum ether is understood to be a mixture of hydrocarbons with a boiling range of 40° to 200° C., or a partial fraction thereof, usual fractions having boiling ranges of approximately 40° to 80° C., 60° to 95° C., 90° to 100° C., 100° to 140° C., 140° to 200° C. Such petroleum ethers are commercially available. These petroleum ethers are also sometimes called benzines.

Preferred mixtures according to the invention have a solidification point TE of less than or equal to 20° C., especially preferred is a TE of less than or equal to 10° C. Pure R112 has a solidification point of about 26° C.; pure R112a a solidification point of approximately 41° C.

Preferred mixtures in accordance with the present invention are characterized by a flash point TF which is preferably at least 21° C. Such mixtures consist e.g. of 90 wt. % R112 and 10 wt. % petroleum ether (with a boiling range of 60° to 95° C.) with a TF of approximately 27° C. or 70 wt. % R112 and 30 wt. % petroleum ether (with a boiling range of 100° to 140° C.) with a TF of approximately 42° C.

Particularly preferred are those mixtures with a flash point TF of greater than or equal to 55° C. Examples of preferred mixtures are given below with the boiling range of the petroleum ether fraction indicated in parentheses:

- 85 wt. % R112+15 wt. % petroleum ether (90° to 100° C.), TF=approximately 56° C.
- 80 wt. % R112+20 wt. % petroleum ether (100° to 140° C.), TF=approximately 62° C.
- 5 wt. % R112+95 wt. % petroleum ether (145° to 200° C.), TF=approximately 62° C.
- 10 wt. % R112+90 wt. % petroleum ether 145° to 200° C.), TF=approximately 80° C.
- 30 wt. % R112+70 wt. % petroleum ether (145° to 200° C.), TF=approximately 108° C.

The flash points of the pure petroleum ether fractions, e.g., a TF of approximately minus 5° C. for 90° to 100° C. petroleum ether or a TF of approximately 0° C. for 100° to 140° C. petroleum ether, are well below the flash points of mixtures according to the invention. Surprisingly, therefore, even small amounts of R112 are capable of raising the flash point of petroleum ether fractions above the preferred limit value. R112 can therefore be used very successfully to increase the flash point of petroleum ethers with a boiling range of 40° to 200° C. or of fractions which boil within this range.

Of course, known additives may be added to the mixtures. One group of known additives is stabilizing agents. This group comprises those compounds which prevent an undesired reaction of constituents of the mixture with each other or with other reactants, for example atmospheric oxygen, water, metals, etc. Known stabilizing agents include, for example, nitroalkanes, particularly nitromethane, nitroethane; alkylene oxides, particularly butylene oxide; or preferably branched alkynols e.g. 2-methyl-butyn-3-ol-2. These stabilizing agents may be used individually or in combination with each other. Stabilizer amounts of 0.01 to 6 wt. %, particularly 0.05 to 1 wt. %, are generally suitable.

Other known additives which may be used include known corrosion inhibitors, known non-ionic or ionic emulsifying agents, etc.

The present mixtures are very good solvents for waxes and have much improved solvent characteristics compared with mixtures of the prior art.

The term "wax" as used in this specification includes natural waxes of vegetable, animal or mineral origin, their chemical modifications and also synthetically produced waxes. The mixtures according to the invention are particularly suitable for dissolving natural waxes.

Such waxes are used in technology in a variety of ways, such as, among others, for temporarily fixing electronic or optical components to be worked on, e.g. semiconductor discs (silicon wafers), optical lenses, etc., or for producing separating agents. The mixtures of the present invention are particularly suitable for removing even the slightest traces of wax or separating agents from components or molds which might otherwise lead to damage.

The present mixtures may furthermore have a variety of uses e.g. as general cleaning agents also for oils and fats or as extraction agents for nonpolar substances. Furthermore, they can also be used as solvents for systems involving dyes e.g. printing inks or also as dispersion agents for pulverized inert materials such as soot, metal powder, ceramic powder, etc.

The invention will be illustrated in further detail by the following non-limiting Examples:

EXAMPLES

Silicon wafers with a diameter of 3 inches (7.6 cm) were fixed temporarily with beeswax and two wax mixtures based on beeswax respectively and then removed. Subsequently they were cleaned at room temperature with the mixtures given in Table 1 using ultrasound (1 or 3 min.) and vapor degreasing for 30 seconds each. The vapor degrasing was carried out in trifluorotrichloroethane (R113).

With the use of mixtures according to the invention, no residues of wax or wax mixture could be detected on the surfaces of the silicon wafers with the naked eye.

With the microscope, using 200-fold magnification, the wafers were examined for remaining specks of wax less than 0.5 μm and greater than 0.5 μm in size. The results are listed in Table 1.

TABLE 1

| Mixture | Wax | Ultra-sound | Wax specks <0.5 μm | Wax specks >0.5 μm |
|---|---|---|---|---|
| 85 wt. % R112 | Beeswax | 1 min. | 0 | 0 |
| + 15 wt. % | Wax mixture A | 1 min. | 0 | 0 |
| Pet. ether (90–100° C.) | Wax mixture B | 1 min. | 0 | 0 |
| 90 wt. % R112 | Beeswax | 1 min. | 0 | 0 |
| + 10 wt. % | Wax mixture A | 1 min. | 0 | 0 |
| Pet. ether (90–100° C.) | Wax mixture B | 1 min. | 0 | 0 |
| Comparison examples | | | | |
| 93 wt. % R112 | Beeswax | 3 min. | 20 | 7 |
| + 7 wt. % | Wax mixture A | 3 min. | 20 | 5 |
| n-heptane (90–100° C.) | Wax mixture B | 3 min. | 20 | visible to naked eye |

The foregoing description and examples have been set forth merely to illustrate the invention and are not intended to be limiting. Since modifications of the described embodiments incorporating the spirit and substance of the invention may occur to persons skilled in the art, the scope of the invention is to be construed solely with reference to the appended claims and equivalents.

What is claimed is:

1. A method of removing a waxy material from an article comprising the step of contacting said article with a mixture of from 5 to 90 wt. % difluorotetrachloroethane and from 10 to 95 wt. % of a petroleum ether.

2. A method as recited in claim 1, wherein said petroleum ether has a boiling range within the range from 40° C. to 200° C.

* * * * *